US005427028A

United States Patent [19]

Nobuta et al.

[11] Patent Number: 5,427,028

[45] Date of Patent: Jun. 27, 1995

[54] PRINTING PLATES LIFTING APPARATUS HAVING STORING FUNCTION

[75] Inventors: Yosuke Nobuta, Yokohama; Kazuaki Shibuya, Tokyo, both of Japan

[73] Assignee: Tokyo Kikai Seisakusho, Ltd., Tokyo, Japan

[21] Appl. No.: 320,208

[22] Filed: Oct. 11, 1994

[30] Foreign Application Priority Data

Nov. 13, 1993 [JP] Japan ..... 5-307572

[51] Int. Cl.[6] ..... B41F 27/12

[52] U.S. Cl. ..... 101/477; 101/415.1; 101/DIG. 36; 271/204; 198/408; 198/410; 198/399; 198/486.1

[58] Field of Search ..... 101/477, 415.1, DIG. 36; 271/204, 185, 225; 198/408, 410, 399, 486.1

[56] References Cited

U.S. PATENT DOCUMENTS

| | | | |
|---|---|---|---|
| 4,874,077 | 10/1989 | Yaguchi et al. | 498/408 |
| 5,074,212 | 12/1991 | Kobler et al. | 101/477 |
| 5,176,081 | 1/1993 | Buus | 101/477 |

FOREIGN PATENT DOCUMENTS

| | | | |
|---|---|---|---|
| 59-165659 | 9/1984 | Japan . | |
| 60-52343 | 3/1985 | Japan . | |
| 2-26584 | 6/1990 | Japan . | |
| 5-1395 | 1/1993 | Japan . | |
| 2127746 | 4/1984 | United Kingdom | 101/477 |

*Primary Examiner*—Eugene H. Eickholt

*Attorney, Agent, or Firm*—Armstrong, Westerman, Hattori, McLeland & Naughton

[57] ABSTRACT

A printing plates lifting apparatus having storing function in a rotary press having upper and lower printing units arranged in tiers and upper and lower work floors corresponding to the printing units. The printing plates lifting apparatus comprises upper and lower rotating bodies, opposed endless flexible bodies which are engaged with vertically opposed upper and lower rotating bodies, driving means for rotating the rotating bodies to run the endless flexible bodies, and printing plate hanging members arranged along and between the endless flexible bodies.

2 Claims, 3 Drawing Sheets

PRINTING PLATES LIFTING APPARATUS HAVING STORING FUNCTION

BACKGROUND OF THE INVENTION

1. Field of the Invention

The present invention relates to a printing plates lifting apparatus in a rotary press having upper and lower press units requiring a printing plate and arranged in tiers, an upper work floor corresponding to the upper press unit and a lower work floor corresponding to the lower press unit, for transferring unused and used printing plates between the two work floors and temporarily storing the printing plates.

2. Description of the Prior Art

Prior-art apparatus for transferring printing plates toward a printing machine are described, for example, in Japanese Patent Application Laid-Open Nos. 59-165659 and 60-52343. These apparatus comprise a conveying apparatus located between a plate making room and the vicinity of a printing machine for conveying prepared printing plates to the vicinity of the printing machine.

Prior-art apparatus for vertically transferring printing plates are described, for example, in Japanese Patent Application Laid-Open Publication No. 2-26584 and Japanese Utility Model Application Laid-Open Publication No. 5-1395. These apparatus are usually located in a plate making room for automatically loading prepared printing plates onto the conveying apparatus described in Japanese Patent Application Laid-Open Nos. 59-165659 and 60-52343.

The prior-art apparatus described in Japanese Patent Application Laid-Open Nos. 59-165659 and 60-52343 are for conveying printing plates to the vicinity of a printing machine located therewith on the same floor level and are not intended to convey printing plates to the upper press unit of a rotary press having upper and lower press units arranged in tiers. The prior-art apparatus, therefore, are unable to carry out such conveyance to the upper press unit and to store printing plates.

According to the prior-art apparatus described in Japanese Patent Application Laid-Open Publication No. 2-26584 and Japanese Utility Model Application Laid-Open Publication No. 5-1395, prepared printing plates transferred to a predetermined position are transferred one by one to a predetermined position where the printing plate is unloaded from vertically transferring means and then loaded onto a conveying apparatus for conveyance to the vicinity of a printing machine. The prior-art apparatus, therefore, are unable to convey printing plates to a press unit and to store printing plates.

Accordingly, it is necessary for a worker to bring up/down a printing plate to be used on an upper press unit and a printing plate having been used on the upper press unit. This labor of bringing a printing plate up and down between upper and lower work floors is quite wasteful, and going up and down the stairs with a printing plate is a problem in terms of the work efficiency and the safety of labor.

SUMMARY OF THE INVENTION

An object of the present invention is to solve the above-mentioned problems.

According to the present invention, there is provided a printing plates lifting apparatus having storing function in a rotary press having upper and lower press units arranged in tiers and upper and lower work floors corresponding to the press units, comprising upper rotating bodies located higher than the top surface of the upper work floor and supported rotatably, lower rotating bodies located higher than the top surface of the lower work floor by more than the length of a printing plate and opposed each other at a spacing greater than the width of the printing plate, opposed endless flexible bodies which are engaged with the vertically opposed upper and lower rotating bodies, driving means for rotating the rotating bodies to run the endless flexible bodies in a circulating fashion, and printing plate hanging members extending between the opposed endless flexible bodies and arranged vertically along the opposed endless flexible bodies at a spacing greater than the length of the printing plate, which upper rotating bodies are rotatably supported on shafts which are mounted such that the opposed ends thereof are spaced greater than the width of the printing plate.

When a worker starts a drive source on the upper or lower work floor for hanging the printing plate on the printing plates lifting apparatus, either lower or upper rotating shafts are rotatively driven. Accordingly, rotating bodies of the rotating shafts cause the endless flexible bodies to run in a circulatory fashion, and consequently, printing plate hanging members circulate up and down. When an appropriate empty printing plate hanging member reaches an appropriate position, the worker stops the drive source to stop the empty printing plate hanging member in the position. The worker hangs a desired printing plate on the empty printing plate hanging member. Thus, the printing plate PP is hung on the printing plates lifting apparatus PL.

For repeatedly hang the printing plate on the printing plates lifting apparatus, the above-mentioned operation is repeated.

In the printing plates lifting apparatus, a printing plates is hung on each of printing plate hanging members arranged along the endless flexible bodies in front and rear columns; thus, a plurality of printing plates are stored hung from printing plate hanging members.

Likewise, for removing a desired printing plate from the printing plates lifting apparatus on the upper or lower work floor, a worker first starts the drive source, as in the case of hanging a printing plate, for vertically circulating printing plate hanging members, i.e. stored printing plates. When a printing plate hanging member carrying a desired printing plate reaches an appropriate position, the worker stops the drive source for stopping the printing plate hanging member in the position. Then, the worker removes the printing plate from the printing plate hanging member.

Thus, the desired printing plate is removed from among a plurality of printing plates stored on the printing plates lifting apparatus in the front and rear columns. As in the case of hanging a printing plate, the work of removing a printing plate is repeated as needed.

In connection with the vertical circulation of printing plates on the printing plates lifting apparatus, there is formed a printing plate hanging zone slightly longer than the length of a printing plate between the rotating shafts and the top floor of the lower work floor, and also the spacing between printing plate hanging members forms a printing plate hanging zone slightly longer than the length of a printing plate. Accordingly, printing plate hanging members are able to pass upper and lower limit positions in a circulatory fashion without any interruption even when a printing plate is hung therefrom.

DETAILED DESCRIPTION OF THE PREFERRED EMBODIMENTS

A press plates lifting apparatus having a press plates storing function according to an embodiment of the present invention will hereinafter be described with reference to the drawings.

Figure 1:
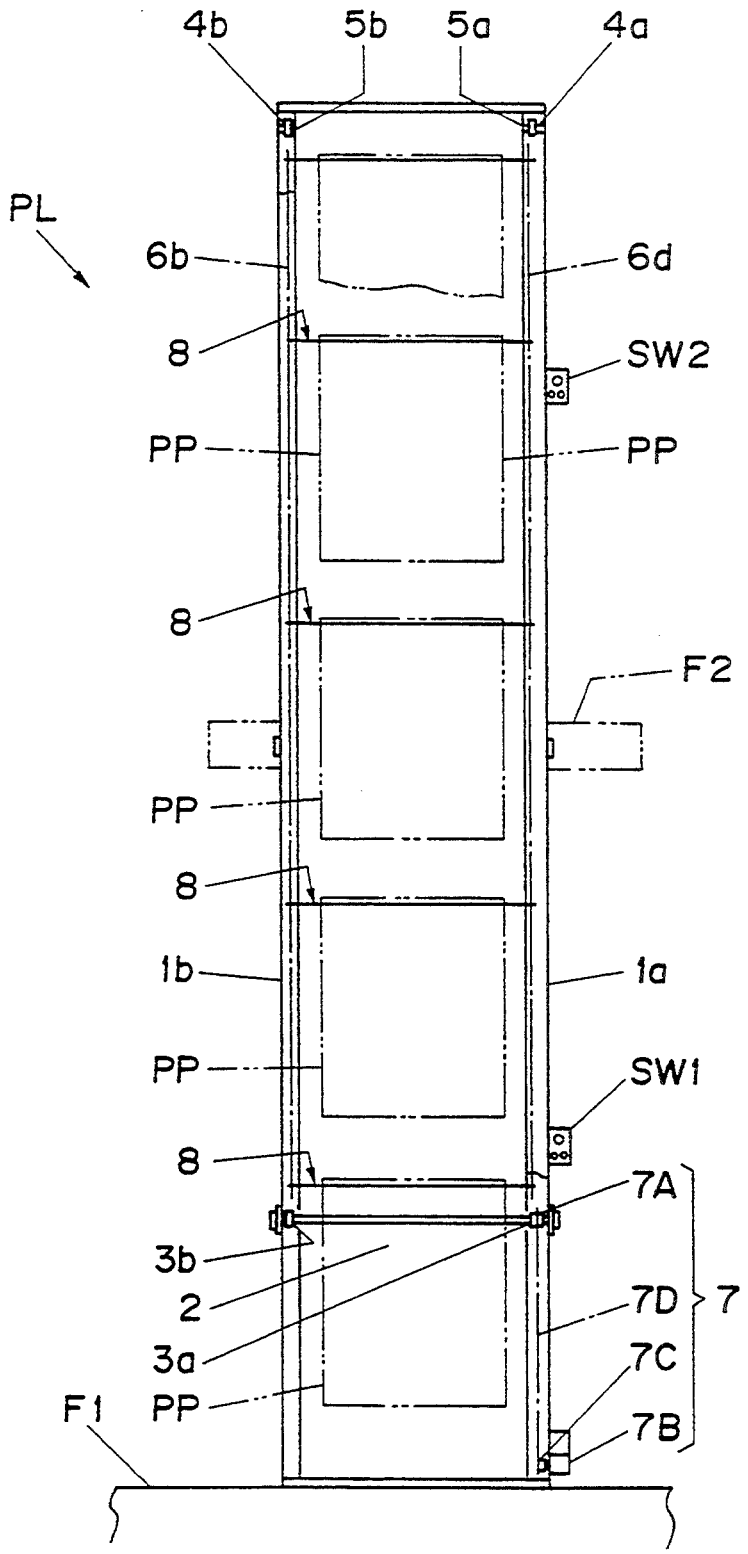
FIG. 1 is a front elevation showing a printing plates lifting apparatus having storing function according to an embodiment of the present invention.
Figure 2:
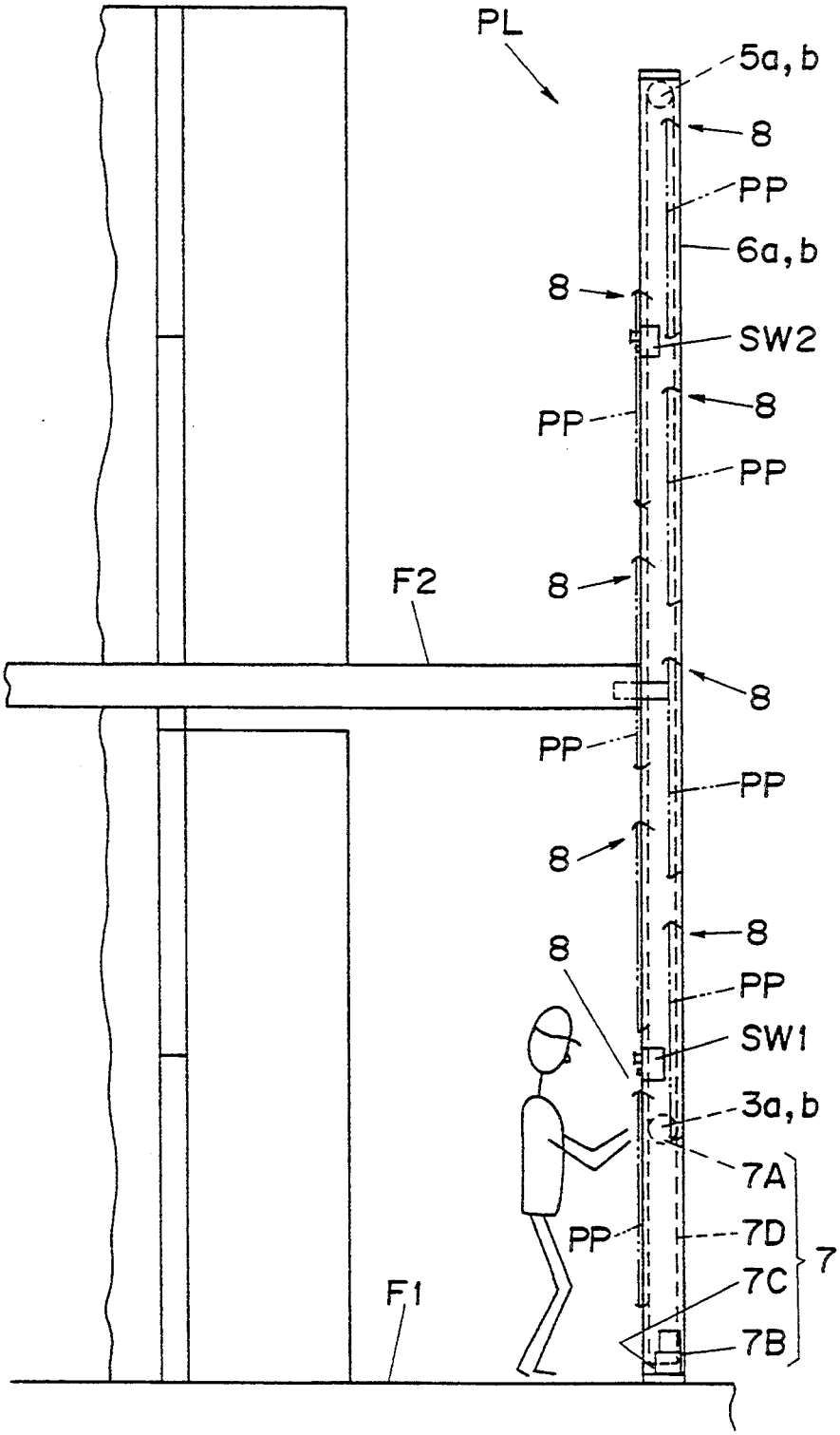
FIG. 2 is a side elevation showing a printing plates lifting apparatus having storing function according to an embodiment of the present invention.

As shown in FIGS. 1 and 2, in the printing plates lifting apparatus PL located along the height of a rotary press RP comprising upper and lower press units arranged in tiers, there is provided two posts 1*a* and 1*b* standing upright from a lower work floor F1, passing the vicinity of an upper work floor F2 and extending above the upper work floor, which two posts are spaced greater than the width of a printing plate PP to be used on the press units. The posts 1*a* and 1*b* are preferably secured to the upper work floor and the like at the intermediate and top end portions thereof.

Both end portions of a through-shaft 2 are rotatably supported on the posts 1*a* and 1*b*, respectively. Lower sprocket wheels 3*a* and 3*b* of the same specification are spaced slightly greater than the width of the printing plate PP and mounted on the through-shaft 2 so as to rotate therewith as a unit. Also, upper sprocket wheels 5*a* and 5*b* are opposed each other at the same level near the top ends of the poles 1*a* and 1*b* and rotatably supported on short shafts 4*a* and 4*b*, respectively, which short shafts are mounted such that the opposed ends thereof are spaced greater than the width of the printing plate PP. The spacing between the upper sprocket wheels 5*a* and 5*b* is identical to that between the lower sprocket wheels 3*a* and 3*b*. The endless chain 6*a*, 6*b* is engaged with vertically opposed upper sprocket wheel 5*a*, 5*b* and lower sprocket wheel 3*a*, 3*b*, respectively.

A follower sprocket wheel 7A is mounted on the through-shaft 2 outside the lower sprocket wheel 3*a* so as to rotate therewith as a unit. An endless chain 7D is engaged with a driving sprocket wheel 7C mounted on the output shaft of a drive source located underneath, such as a geared motor 7B equipped with a brake, and with the follower sprocket wheel 7A mounted on the through-shaft 2, thereby constructing driving means 7.

Press plate hanging members 8, 8, . . . are mounted between the endless chains 6*a* and 6*b* and spaced slightly greater than the length of the printing plate PP along the endless chains.

In an embodiment shown in FIGS. 1 and 2, a linking pitch 6P*a*, 6P*b* of a link 61*a*, 61*b* of the endless chain 6*a*, 6*b* is double the linking pitch of ordinary chains (for example, BI-PITCH CHAIN (trademark) is a chain of such double-pitch type). A through-bar 8*a* of the printing plate hanging member 8 is rotatably supported on opposed links 61*a* and 61*b* at the intermediate portion thereof, and the axial displacement of the through-bar is prevented with a pin 8*d* (e.g. split pin). In place of the through-bar 8*a*, used may be opposed short bars 8*b* and 8*c* which are mounted such that the base ends thereof are rotatably supported on the opposed links 61*a* and 61*b* at the intermediate portion of the links as for both ends of the through-bar 8*a*, the opposed ends thereof are spaced smaller than the width of the printing plate PP, and the axial displacement thereof is prevented with the pin 8*d* (e.g. split pin). The short bars 8*b* and 8*c* may be unequal in length. A retaining ring may be used as means for preventing the axial displacement of the through-bar 8*a* and the short bars 8*b* and 8*c*.

Figure 3:
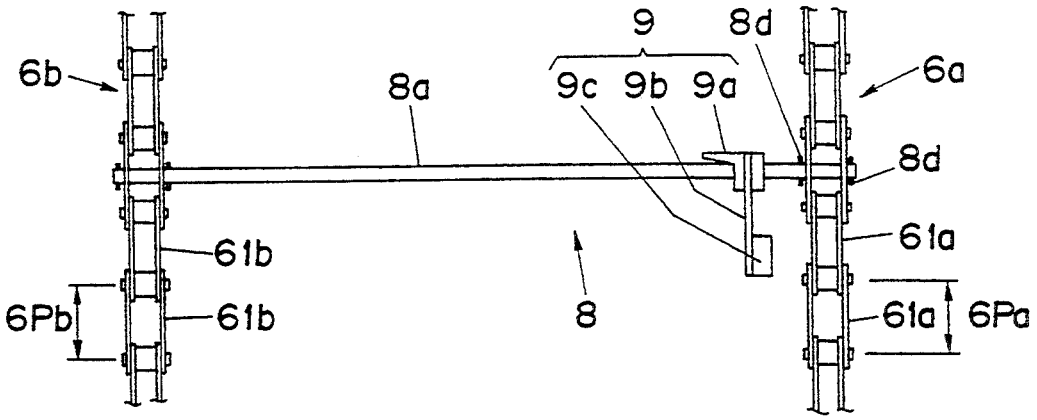
FIG. 3 is an enlarged view showing the essential portions of a printing plates lifting apparatus having storing function according to an embodiment of the present invention.
Figure 4:
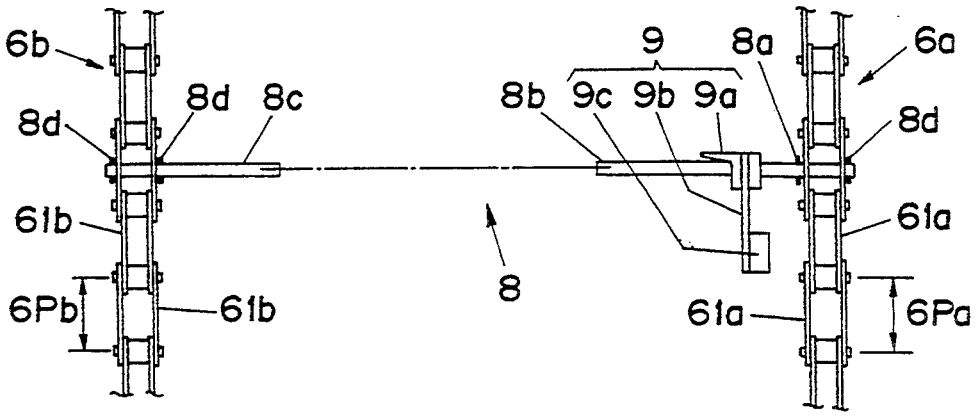
FIG. 4 is an enlarged view showing a different type of the essential portions of a printing plates lifting apparatus having storing function according to an embodiment of the present invention.
Figure 5:
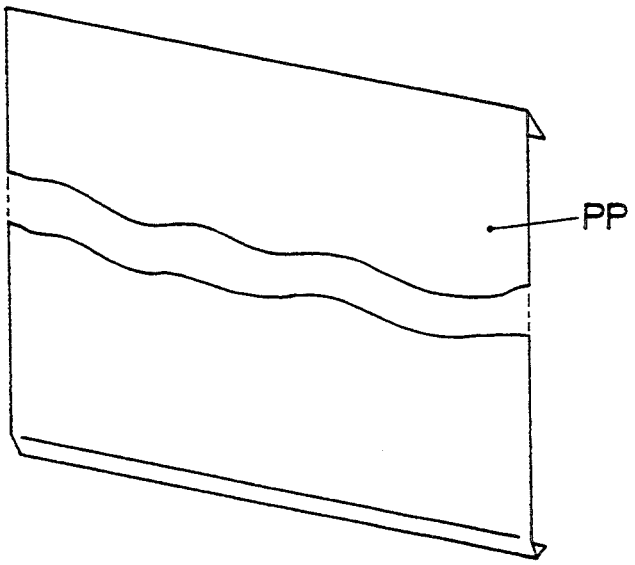
FIG. 5 is a perspective view showing a printing plate to be stored on a printing plates lifting apparatus having storing function according to an embodiment of the present invention.

Preferably, as shown in FIGS. 3 and 4, a drop preventing member 9 is fit onto one end of the through-bar 8*a* and/or either of the short bars 8*b* and 8*c* (the short bar 8*b* in the illustrated example). An elastic nail-like holder 9*a* is formed on the drop preventing member 9. To maintain the elastic nail-like holder 9*a* in such an angular position in the rotating direction as to readily hold a printing plate, a weight 9*c* is mounted on the drop preventing member 9 through an arm portion 9*b* projecting in an appropriate angular direction.

When the through-bar 8*a* and the short bars 8*b* and 8*c* are of a round bar or a near-round polygonal section bar, the through-bar 8*a* and the short bars 8*b* and 8*c* may be supported on the links 61*a* and 61*b* in a nonrotatable fashion. If the bars are supported in a nonrotatable fashion, the drop preventing member 9 will not be provided.

Operation switches SW1 and SW2 are located on the printing plates lifting apparatus PL (e.g. the post 1*a* or 1*b*) or in the vicinity thereof so that a worker can start/-stop the geared motor 7B equipped with a brake on the lower work floor F1 and the upper work floor F2, respectively, using the switches.

Actions of the above-mentioned printing plates lifting apparatus will hereinafter be described.

When a worker wants to hang the printing plate PP on the printing plate lifting apparatus PL on the lower work floor F1, the worker first operates the operation switch SW1 to start the geared motor 7B equipped with a brake. When the motor is started, the through-shaft 2 is rotatively driven (e.g. clockwise in FIG. 2) through the driving sprocket wheel 7C, the endless chain 7D and the follower sprocket wheel 7A. Then, the endless chains 6*a* and 6*b* run in a circulatory fashion through the lower sprockets 3*a* and 3*b*, thereby vertically circulating the printing plate hanging members 8, 8, . . . . When an appropriate empty printing plate hanging member 8 reaches an appropriate position, the worker operates the operation switch SW1 to stop the geared motor 7B equipped with a brake, thereby stopping the empty printing plate hanging member 8 in the position.

Next, the worker manually hangs the printing plate PP on the empty printing plate hanging member 8. In the illustrated example, a bend portion PP1 formed by bending the edge of the printing plate across the width thereof is hung on the through-bar 8*a* or the short bars 8*b* and 8*c*. When the drop preventing member 9 is provided, a weight 9*c* thereof maintains the rotative through-bar 8*a* or the short bar 8*b* in such an angular position in the rotating direction that the elastic nail-like holder 9*a* is held in a predetermined position (e.g. top position). The worker slides the printing plate PP toward the drop preventing member 9 to retain one corner portion thereof under the elastic nail-like holder 9*a* of the drop preventing member 9.

Thus, the printing plate PP is hung on the printing plates lifting apparatus PL.

For repeatedly hanging the printing plate PP on the printing plates lifting apparatus PL, the worker repeats the above-mentioned operation. As a result, the printing plate PP is hung on each of the printing plate hanging members 8, 8, . . . (eight members in the illustrated example) arranged in the front and rear columns along the endless chains 6*a* and 6*b*, thereby hanging eight printing plates PP for storage.

When the worker wants to remove the printing plate PP from the printing plate lifting apparatus PL on the lower work floor F1, the worker first operates the operation switch SW1 to start the geared motor 7B equipped with a brake as in the case of hanging the printing plate. When the motor is started, the printing plate hanging members 8, 8, . . . , i.e. the printing plates PP, PP, . . . are circulated vertically. When the printing plate hanging member with a desired printing plate PP hanging therefrom reaches an appropriate position, the worker operates the operation switch SW1 to stop the geared motor 7B equipped with a brake, thereby stopping the printing plate hanging member 8 in the position.

Next, the worker detaches the bend portion PP1 of the printing plate PP from the through-bar 8*a* or the short bars 8*b*, 8*c*, thereby removing the printing plate PP from the printing plate hanging member 8, i.e. from the printing plates lifting apparatus PL. When the drop preventing member 9 is provided, the worker slides the printing plate PP laterally to move the printing plate away from the drop preventing member 9, thereby detaching the corner portion of the printing plate from the elastic nail-like holder 9*a* of the drop preventing member 9. Then, the worker detaches the bend portion PP1 of the printing plate PP from the through-bar 8*a* or the short bars 8*b* and 8*c* to remove the printing plate PP from the printing plates lifting apparatus.

Thus, the desired printing plate PP has been removed from among a plurality of printing plates PP (eight printing plates in the illustrated example) stored on the printing plates lifting apparatus PL in the front and rear columns.

As in the case of the hanging work, the above-mentioned removing work is repeated as needed.

In connection with the vertical circulation of the printing plates PP, PP, . . . on the printing plates lifting apparatus PL, there is formed a printing plate hanging zone slightly longer than the length of the printing plate PP between the through-shaft 2 and the top floor of the lower work floor F1, and also the spacing of the printing plate hanging members 8, 8, . . . forms a printing plate hanging zone slightly longer than the length of the printing plate PP. Also, the upper sprocket wheels 5*a* and 5*b* are rotatably supported on the short shafts 4*a* and 4*b*, respectively, which short shafts are mounted such that the opposed ends thereof are spaced greater than the width of the printing plate PP. Hence, even when the printing plate PP is hung from the printing plate hanging members 8, 8, . . . , the printing plate hanging members can pass the position of the lower sprocket wheels 3*a* and 3*b* and the position of the upper sprocket wheels 5*a* and 5*b* without any interruption.

When the worker wants to hang the printing plate PP on or remove from the printing plates lifting apparatus PL on the upper work floor F2, the worker operates the operation switch SW2 in place of the operation switch SW1 and carries out the same work as that on the lower work floor F1.

When work is carried out in parallel on both the lower work floor F1 and the upper work floor F2, the workers on both floors need to cooperate with each other to secure safety. For securing safety in such parallel work, for example, it will be effective to provide each of the operation switches SW1 and SW2 with a safety circuit to lock the operation of the geared motor 7B equipped with a brake.

A printing plates lifting apparatus having storing function of the present invention in a rotary press having upper and lower printing units arranged in tiers allows an appropriate number of printing plates to be stored and lifted up and down in the stored state. Accordingly, printing plates used on the upper printing unit can be stored in sequence, and also a desired printing plate can be selected and removed from among stored unused printing plates for use on the upper printing unit.

Hence, it is not necessary for a worker to bring down a printing plate used on the upper printing unit from the upper work floor to the lower work floor or to bring up a printing plate for use on the upper printing units from the lower work floor to the upper work floor, thereby improving the work efficiency and the safety of labor.

What is claimed is:

1. A printing plates lifting apparatus having storing function in a rotary press having upper and lower printing units arranged in tiers and upper and lower work floors corresponding to said printing units, comprising upper rotating bodies located higher than the top surface of said upper work floor and opposed each other at a spacing greater than the width of said printing plate, lower rotating bodies located higher than the top surface of said lower work floor by more than the length of said printing plate and opposed each other at a spacing greater than the width of said printing plate, opposed endless flexible bodies which are engaged with said vertically opposed upper and lower rotating bodies, driving means for rotating said rotating bodies to run said opposed endless flexible bodies in a circulatory fashion, and printing plate hanging members extending between said opposed endless flexible bodies and arranged vertically along said opposed endless flexible bodies at a spacing greater than the length of said printing plate.

2. A printing plates lifting apparatus having storing function according to claim 1, wherein said upper rotating bodies are rotatably supported on shafts which are mounted such that the opposed ends thereof are spaced greater than the width of said printing plate.

* * * * *